US006161924A

United States Patent [19]

Mitani et al.

[11] Patent Number: 6,161,924

[45] **Date of Patent: *Dec. 19, 2000**

[54] INK JET RECORDING HEAD

[75] Inventors: Masao Mitani; Kenji Yamada; Osamu Machida; Kazuo Shimizu; Katsunori Kawasumi, all of Hitachinaka, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/857,858

[22] Filed: May 16, 1997

[30] Foreign Application Priority Data

May 17, 1996 [JP] Japan ..... 8-122091

[51] Int. Cl.[7] ..... B41J 2/05

[52] U.S. Cl. ..... 347/64

[58] Field of Search ..... 347/62, 64, 63

[56] References Cited

U.S. PATENT DOCUMENTS

| | | | |
|---|---|---|---|
| 4,535,343 | 8/1985 | Wright et al. | 347/64 |
| 4,777,583 | 10/1988 | Minami et al. | 347/208 |
| 5,122,812 | 6/1992 | Hess et al. | 347/59 |
| 5,710,583 | 1/1998 | Mitani | 347/62 |
| 5,808,640 | 9/1998 | Bhaskar et al. | 347/62 |

FOREIGN PATENT DOCUMENTS

| | | |
|---|---|---|
| 48-9622 | 2/1973 | Japan . |
| 54-51837 | 4/1979 | Japan . |

OTHER PUBLICATIONS

Nikkei Mechanical, Dec. 28, 1992, pp. 58–63.

Jeffrey P. Baker, et al.; "Design and Development of a Color Thermal Ink Jet Print Cartridge", Hewlett–Packard Journal, Aug. 1988, pp. 6–32.

"Heat Transmission Data", Japan Mechanical Association, vol. 4, 1986.

Yoshihiro Uda, et al, "Boiling Nucleation on Very Small Film Heater Subjected to Extremely Rapid Heating", Japan Mechanical Association Paper, vol. 60–572(B), Apr., 1994.

*Primary Examiner*—John Barlow
*Assistant Examiner*—Michael S. Brooke
*Attorney, Agent, or Firm*—McGuireWoods, LLP

[57] ABSTRACT

In an ink jet recording head, the thin-film thermal resistor is covered by an electrically-insulating oxidation film. An inorganic insulation layer is formed over a part of the thin-film thermal resistor and the thin-film conductor. An organic insulation layer is formed over at least a part of the inorganic insulation layer that covers the connecting edge of the connection portion between the thin-film thermal resistor and the thin-film conductor.

23 Claims, 6 Drawing Sheets

INK JET RECORDING HEAD

BACKGROUND OF THE INVENTION

1. Field of the Invention

The present invention relates to a recording device for using thermal energy to eject ink droplets towards a recording medium.

2. Description of the Related Art

Japanese Patent Application (KOKAI) No. SHO-48-9622 and NO. SHO-54-51837 describe ink jet recording devices that apply pulses of heat to ink to rapidly vaporize a portion of the ink and eject an ink droplet from an orifice using the expansion of the vaporized ink.

As described on page 58 in the Dec. 28, 1992 edition of Nikkei Mechanical and in the August 1988 edition of Hewlett Packard-Journal, the simplest method for applying pulses of heat to ink is by energizing thermal resistors, otherwise known as heaters. The common configuration of these conventional heaters includes: a thin-film resistor; a thin-film conductor; an anti-oxidation layer having about 3 $\mu$m thickness and formed on these thin films; and an anti-cavitation Ta metal layer having about 0.5 $\mu$m thickness and formed on the anti-oxidation layer to prevent cavitation thereof.

Because of the thick protection layers, this configuration requires energy as large as 15 to 30 $\mu$J/pulse for ejecting each ink droplet. A large part of this energy is consumed for heating up the substrate.

SUMMARY OF THE INVENTION

In order to solve this problem, copending U.S. patent application Ser. No. 08/580,273 (not prior art) and copending U.S. patent application (not prior art) entitled "INK JET PRINTING DEVICE", filed by Mitani et al, on Dec. 23, 1996 have proposed a protection-layerless heater made from Ta—Si—O ternary alloy. A surface of the Ta—Si—O ternary alloy thin-film resistor is oxidized to form an oxidation film with an approximately 100 Å thickness. The oxidation film is excellent in an electric insulation and in mechanical strength.

Because the protection layers are not formed on the heater, efficiency of heat transmission from the heater to ink is greatly improved. Accordingly, it is sufficient that this heater be supplied with an energy as small as 2.4 to 2.7 $\mu$J/pulse for ejecting each ink droplet. The heating speed can be improved to as high as $1\times10^8$ to $5\times10^8$ K/s for stable ink ejection.

It is noted that an electrode for energizing the Ta—Si—O ternary alloy thin-film resistor should be formed from metal which exhibits an excellent anti-corrosion against cavitation damages in ink. Though nickel is considered to be optimal for forming the electrode, ink will likely corrode the thin-film nickel conductor located on a positive electrode side. This thin-film nickel conductor cannot be used for a long period of time.

In view of the problem, the copending U.S. patent application Ser. No. 08/580,273 (not prior art) has proposed a top shooter type ink jet recording head shown in FIG. 1, wherein an individual thin-film nickel conductor 5 at the positive electrode side is covered with a partition wall 7. The partition wall 7 is formed from a thermal resistant resin such as polyimide whose thermal breakdown start temperature is 400° C. or more. In order to certainly protect the conductor 5 from heat generated at the heater 3, the partition wall 7 extends to partially cover an oxidation film 4 on a Ta—Si—O ternary alloy heater 3. Though temperature of this surface area of the oxidation film 4 reaches to 370° C. at maximum when the pulse of heat is applied, because the conductor 5 is certainly protected by the partition wall 7 from heat, the ink jet recording head can tolerate even one hundred million pulses of heat.

The present inventors have performed researches on the ink jet recording head of FIG. 1 in a manner described below.

An ink jet recording head was produced to have the structure of FIG. 1 and to include 1,000 through 10,000 or more nozzles on a single substrate for a full color large-scale printer. Some of the nozzles were observed to have an insufficiently short life. This is because temperature of some heaters reached to more than 400° C. at the portion covered with the resin partition wall 7. Because thermal breakdown start temperature of the polyimide is about 400° C., the polyimide was broken down, that is, decomposed, thereby causing galvanization corrosion in the individual electrodes 5 and shortening lives of the corresponding nozzles.

Considering the test results, the present inventors theoretically analyze the performance of the ink jet recording head of FIG. 1 in a greater detail as described below.

Temperature of the thin-film resistor 3 changes in time when the thin-film resistor 3 is supplied with an energization pulse. This temperature change can be calculated based on a one dimensional thermal transmission model as descried in "Heat Transmission Data", Volume 4, published by Japan Mechanical Association in 1986. It is noted that the oxidation film 4 has little effect on this calculation, and therefore the effect from the oxidation film 4 is neglected.

This calculation is performed assuming that the thin-film resistor 3 has a thickness of about 0.1 $\mu$m and has a square shape with equal 50 $\mu$m sides. The thin-film resistor 3 is provided over a $SiO_2$ insulation layer 2 having a thickness of about 2 $\mu$m. A part of the upper surface (oxidized film 4) of the thin-film resistor 3 is exposed to ink 8, and a remaining part is exposed to the insulation layer 7. The energization power is applied to the thin-film resistor 3 in pulses with pulsewidth of 1 microsecond.

As described in another copending U.S. patent application Ser. No. 08/740,895 (not prior art), it is preferable to cause the square-shaped heater 3 to induce a caviar-wise nucleation boiling in order to control the print head to perform a high quality ejection. Assuming that pure water or water-based ink is used, it is necessary to supply the square-shaped heater 3 with energization power of 2.4 W×1 $\mu$s in order to allow the heater 3 to induce the caviar-wise nucleation boiling phenomenon.

According to the one dimensional thermal transmission model, when supplied with energization power of 2.4 W×1 $\mu$s, the maximum temperature of the heater surface, exposed to the ink, is theoretically calculated to reach 317° C. On the other hand, an actual maximum temperature measured by a test using pure water is 295° C. The test result is shown in a document entitled "Boiling Nucleation on Very Small Film Heater Subjected to Extremely Rapid Heating" written by Iida et al. (Japan Mechanical Association Paper, Volume 60-572 (B), published in April, 1994). It is therefore apparent that the calculated temperature substantially approximates the actually-measured temperature. It can be predicted that the same result will be obtained when water-based ink is used instead of pure water.

It is now assumed that polyimide is used for forming the insulation layer 7 and that the same amount of energy is applied to the thin-film resistor 3. In this case, a maximum temperature of a heater surface covered with the insulation layer 7 is calculated to reach 410° C. Taking an error between the calculated result and the measured result in the same degree as obtained for the case where the heater 3 is exposed to ink, the actual maximum temperature is estimated to be 380° C.

This estimation suggests that the thin-film resistor 3 be possibly heated beyond the thermal breakdown start temperature (400° C.) of polyimide due to inevitable variation, in size of the thin-film resistor 3, which is generated during the head manufacturing process. More specifically, the thickness of the thin-film resistor 3 inevitably varies when the thin-film resistor 3 is formed through a sputtering process, and the size of the thin-film resistor 3 also inevitably varies when the thin-film resistor 3 is etched through a photoetching process. The resistance value of the thin-film resistor 3 varies due to the thus inevitably-produced variation in the thickness and size of the thin-film resistor 3. Heat generated at the thin-film resistor 3 will therefore vary even applied with the same electric voltage. The temperature at the surface of the thin-film resistor 3 will vary. Accordingly, the temperature may possibly exceed the thermal breakdown start temperature of polyimide.

It is therefore an objective of the present invention to provide an improved structure for protecting the thin-film conductor against heat.

It is another object of the present invention to provide an ink jet recording heat which is highly reliable and which has a greatly-improved thermal efficiency.

In order to attain the above and other objects, the present invention provides an ink jet recording head, comprising: a base substrate defining an ink chamber thereon; a nozzle portion formed with a nozzle connecting the ink chamber with atmosphere; a thin-film thermal resistor, formed to the base substrate in correspondence with the nozzle, for being pulsingly energized to rapidly vaporize a portion of the ink and to eject an ink droplet from the nozzle using the expansion of the vaporized ink, the thin-film thermal resistor being covered with an electrically-insulation oxidation layer formed by oxidation of the thin-film thermal resistor; a thin-film conductor connected, at a connection portion, to the thin-film thermal resistor for supplying an energization pulse to the thin-film resistor; an inorganic thermal insulation layer provided over a part of the thin-film thermal resistor and the thin-film conductor; and an organic thermal insulation layer covering at least a part of the inorganic thermal insulation layer that covers the connection portion between the thin-film thermal resistor and the thin-film conductor.

According to another aspect, the present invention provides an ink jet recording head, comprising: a base substrate defining an ink chamber thereon; a nozzle portion formed with a nozzle connecting the ink chamber with atmosphere; a thin-film thermal resistor, formed to the base substrate in correspondence with the nozzle, for being pulsingly energized to rapidly vaporize a portion of the ink and to eject an ink droplet from the nozzle using the expansion of the vaporized ink, the thin-film thermal resistor being covered with an electrically-insulation oxidation layer formed by oxidation of the thin-film thermal resistor; a thin-film conductor connected, at a connection portion, to the thin-film thermal resistor for supplying an energization pulse to the thin-film resistor, the connection portion having a connecting edge; an inorganic thermal insulation layer provided over a part of the thin-film thermal resistor and the thin-film conductor; and an organic thermal insulation layer covering at least a part of the inorganic thermal insulation layer that covers the connecting edge of the connection portion between the thin-film thermal resistor and the thin-film conductor.

According to a further aspect, the present invention provides an ink jet recording device, comprising: a base substrate defining an ink chamber thereon; an ink supply portion for supplying ink to the ink chamber; a nozzle portion formed with a nozzle connecting the ink chamber with atmosphere; a thin-film thermal resistor, formed to the base substrate in correspondence with the nozzle, for being pulsingly energized to rapidly vaporize a portion of the ink and to eject an ink droplet from the nozzle using the expansion of the vaporized ink, the thin-film thermal resistor being covered with an electrically-insulation oxidation layer formed by oxidation of the thin-film thermal resistor; a thin-film conductor connected at a connection portion, to the thin-film thermal resistor for supplying an energization pulse to the thin-film resistor; an inorganic thermal insulation layer provided over a part of the thin-film thermal resistor and the thin-film conductor; and an organic thermal insulation layer covering at least a part of the inorganic thermal insulation layer that covers the connection portion between the thin-film thermal resistor and the thin-film conductor.

BRIEF DESCRIPTION OF THE DRAWINGS

The particular features and advantages of the invention as well as other objects will become more apparent from the following description taken in connection with the accompanying drawings, in which:

FIG. 3(*b*) is a sectional view showing an ink jet recording head of the first embodiment taken along a line IIIB-IIIB' of FIG. 3(*a*);

FIG. 6(*b*) is a sectional view showing an ink jet recording head of the second embodiment taken along a line VIB-VIB' of FIG. 6(*a*).

DETAILED DESCRIPTION OF THE PREFERRED EMBODIMENTS

Figure 1:
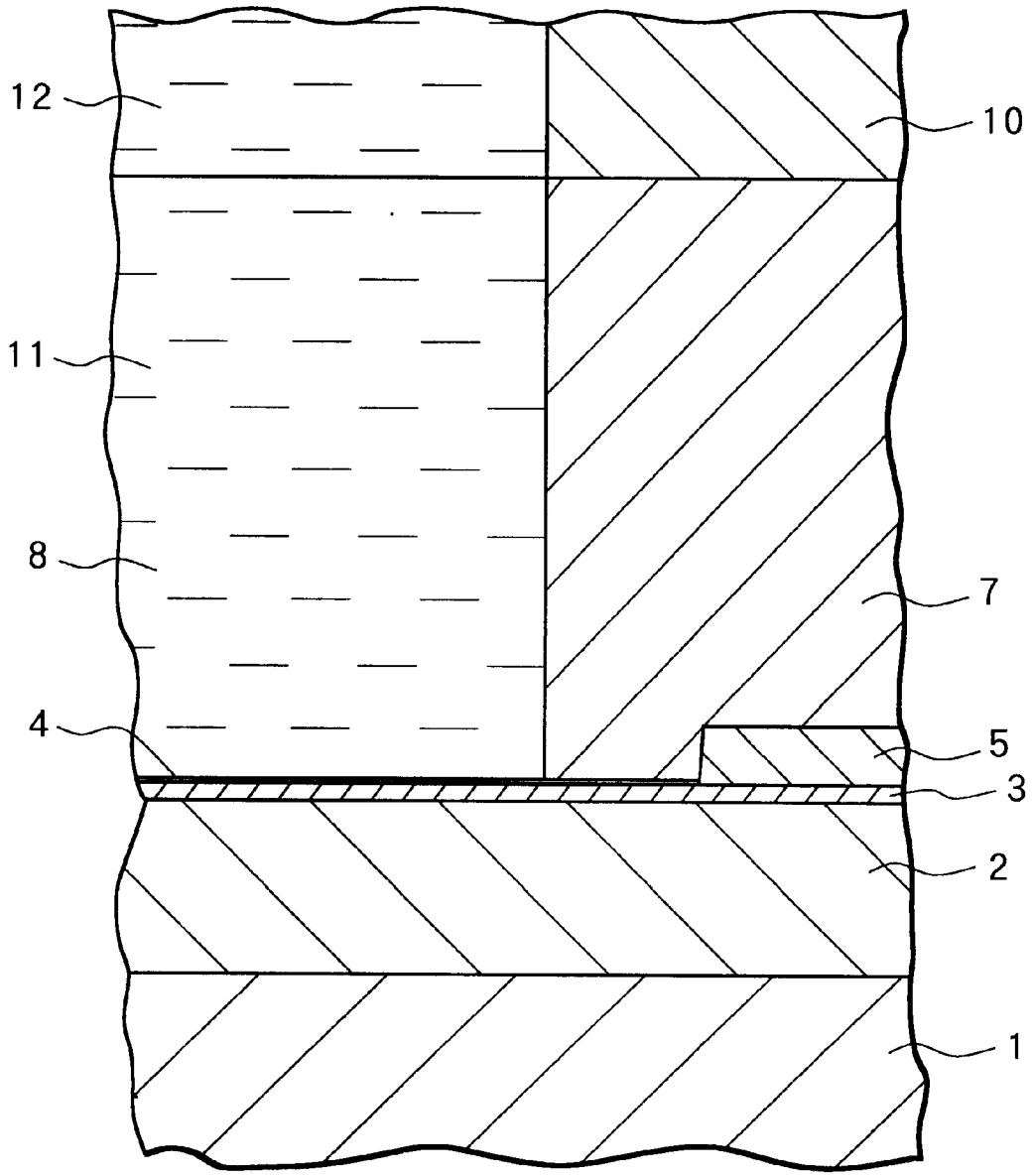
FIG. 1 is a cross-sectional view showing an ink jet recording head of a copending application (not prior art)

An ink jet recording head according to a preferred embodiment of the present invention will be described while referring to the accompanying drawings wherein like parts and components are designated by the same reference numerals to avoid duplicating description.

A first embodiment will be described below with reference to FIGS. 2 through 4(*a*) through 4(*d*).

The first embodiment is a top shooter type ink jet recording head.

Figure 3:
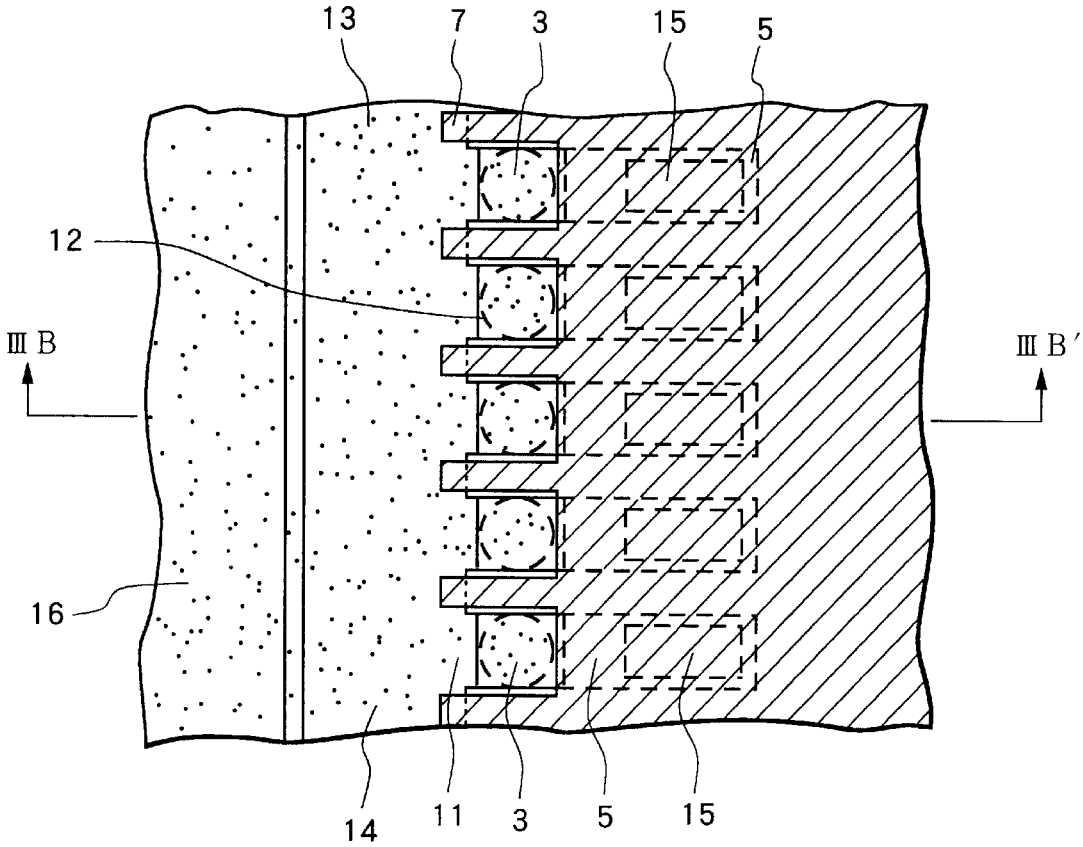
FIG. 3(*a*) is a cross-sectional view showing an ink jet recording head of the first embodiment taken along a line IIIA-IIIA' of FIG. 3(*b*)
Figure 3:
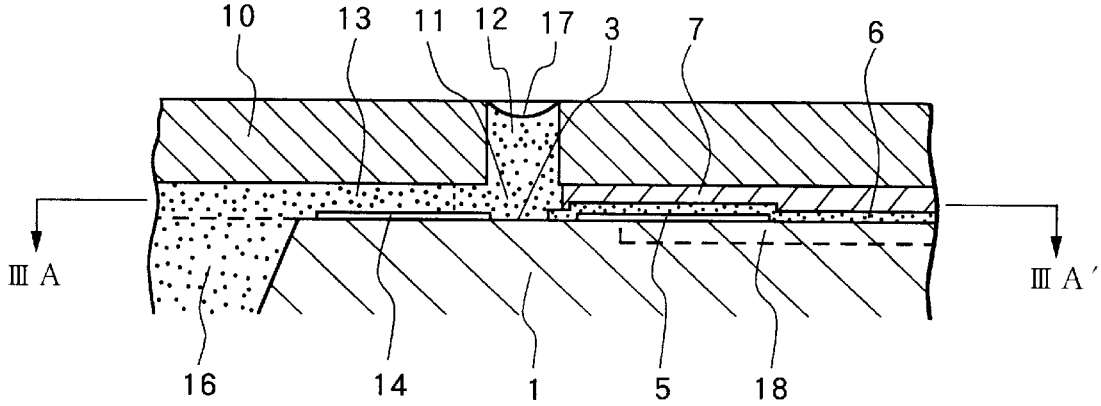

In the top shooter type ink jet print head of the present embodiment, as shown in FIGS. 3(*a*) and 3(*b*), a partition wall 7 is provided over a silicon substrate 1 for defining a plurality of individual ink channels 11 and a common ink channel 13. The silicon substrate 1 is formed with an ink supply groove 16 for supplying ink to the common ink channel 13. The ink supply groove 16 is in fluid communication with an ink cartridge (not shown). A nozzle plate 10 is provided over the partition wall 7. The nozzle plate 10 is formed with a plurality of ink ejection nozzles 12 juxtaposed along a line. The nozzles 12 are in fluid communication with corresponding individual ink channels 11. The common ink channel 13 connects the ink channels 11 to one another. A thin-film resistor 3 is formed at the end of each ink channel 11 in confrontation with the nozzle 12. Two thin-film conductors 5 and 14 are connected to each heater 3. The thin-film conductor 5 serves as an individual electrode for the corresponding resistor 3. The thin film conductor 14 serves as a common electrode for all the resistors 3.

The partition wall 7 is made from an organic insulation material such as a heat-resistant resin. Preferably, the partition wall 7 is made from polyimide which has a thermal breakdown starting point of 400° C. or more. The nozzles plate 10 may be made from the same material with the partition wall 7.

Figure 2:
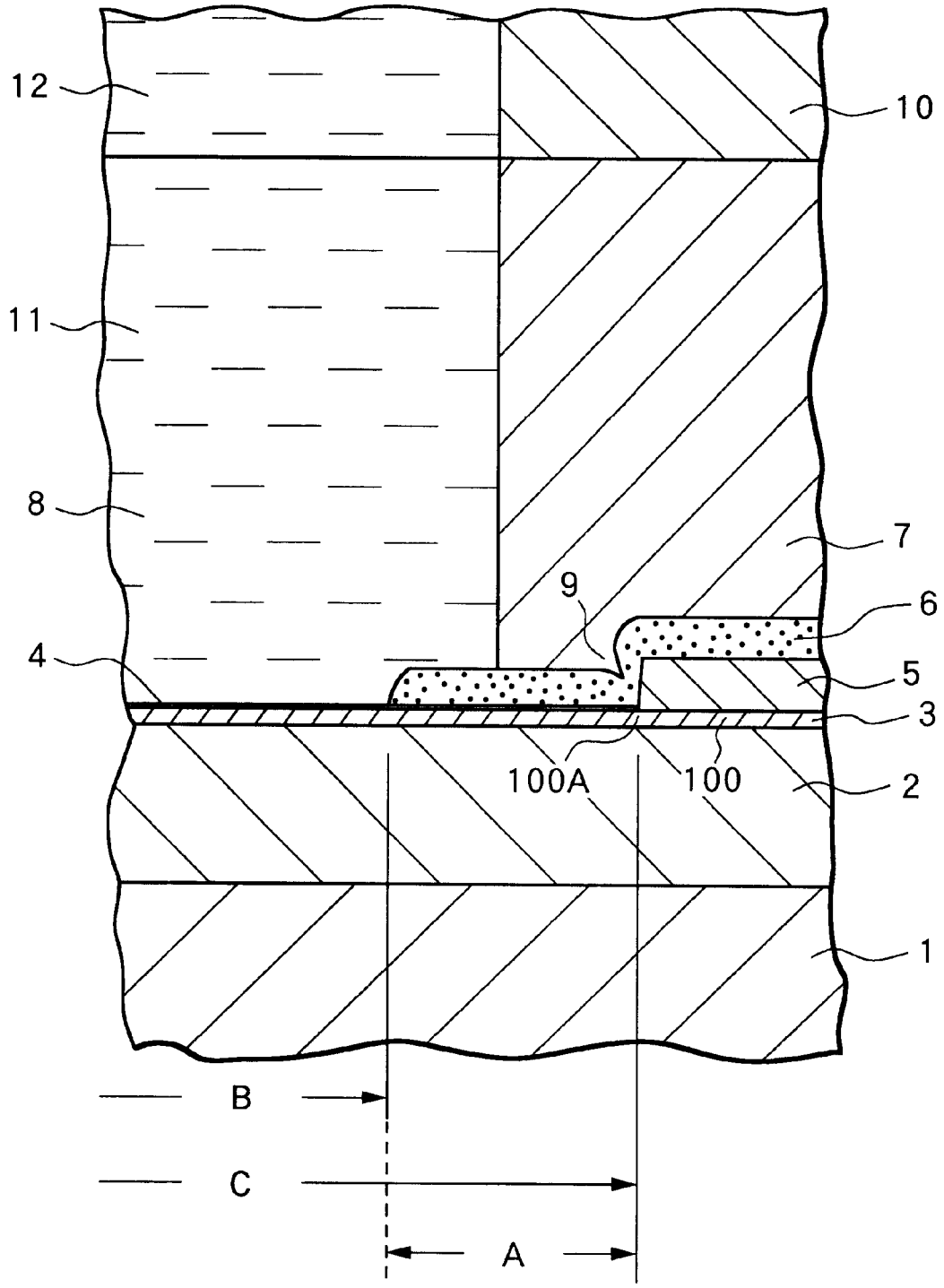
FIG. 2 is an enlarged sectional view of an ink jet recording head of a top shooter type according to a first embodiment of the present invention.

According to the present embodiment, as shown in FIGS. 2, 3(*a*), and 3(*b*), the partition wall 7 covers, via an inorganic insulation layer 6, all of the individual conductors 5 and part of the heaters 3.

The inorganic insulation layer 6 is made of inorganic insulation material, such as $SiO_2$ and $Ta_2O_5$, having low thermal conductivity. The inorganic insulation layer 6 is provided at a position between the organic insulation wall 7 and the thin-film resistor 3 and the individual conductor 5. The inorganic insulation layer 6 is provided for decreasing the maximum temperature, to which the organic insulation layer 7 is exposed, thereby preventing the insulation layer 7 from being thermally broken down, that is, from being thermally decomposed.

As shown in FIGS. 3(*a*) and 3(*b*), a drive LSI device 18 is formed on the silicon substrate 1. The drive LSI device 18 is constructed from a shift register circuit and a plurality of drive circuits. Each conductor 5 is connected to a corresponding drive circuit by passing through a through-hole 15. This configuration allows sequential drive of the resistors 3 by an external signal supplied to the drive LSI device 18.

The heater 3 and the conductors 5 and 14 will be described below in greater detail with reference to FIG. 2. FIG. 2 is a sectional magnified view showing the area around one of the ink ejection nozzles 12 shown in FIGS. 3(*a*) and 3(*b*).

The heater 3 is provided over an approximately 1 to 2 micrometer thick $SiO_2$ insulation layer 2 which is provided over the silicon substrate 1. This $SiO_2$ layer 2 is for insulating the silicon substrate 1 from heat generated at the heater 3. Each heater 3 is formed to an approximately 0.1 micrometer thickness from Ta—Si—O ternary alloy, for example, which is very stable for pulsive operation up to the temperature of about 400° C. The conductors 5 and 14 are formed on the heater 3 from 1 $\mu$m thick nickel (Ni) thin-film conductors.

The Ta—Si—O ternary alloy thin film 3 will be described below in greater detail.

The Ta—Si—O ternary alloy thin film 3 is formed on the $SiO_2$ insulation layer 2 of the substrate 1 which is placed in a DC sputtering device wherein a high voltage is applied in a low pressure argon atmosphere, whereupon the argon atoms ionize. By applying an electric field, the argon ions are accelerated and collide with a target made of tantalum (Ta) and silicon (Si). Atoms or small clumps of the target are blown off the target and accumulated onto the substrate.

In the DC sputtering device, a direct-current electric voltage is applied to the target. The target is adjusted to a predetermined surface area ratio of Ta to Si. For example, the target, with surface area of Ta to the surface area of Si adjusted to a ratio of 70 to 30, is placed in confrontation with the $SiO_2$ insulation layer 2 of the silicon substrate 1 in a vacuum chamber of the DC sputtering device. The vacuum chamber is then exhausted to a vacuum of $5\times10^{-7}$ Torr or less. Afterward, argon gas including a predetermined amount of oxygen is introduced into the vacuum chamber until the partial pressure of argon gas is 1 to 30 mTorr and the partial pressure of oxygen gas is $1\times10^{-4}$ to 1 mTorr. The target is then energized with a voltage of 400 V to 10,000 V to induce glow discharge. A Ta—Si—O thin film having a predetermined composition is formed to a thickness of approximately 1,000 Å by reactive sputtering on the silicon substrate. In reactive sputtering, a gas, such as nitrogen or, as in the present example, oxygen, that easily reacts in a low pressure argon atmosphere is mixed with the argon gas. The ionized gas accumulates on the substrate while reacting with the atoms and the like which are blown off the target and which are in an easily reactive state. The silicon substrate 1 is rotated while the Ta—Si—O thin film is generated. No particular heating is performed other than baking the silicon substrate.

Measurements were carried on a variety of samples having a broad range of the Ta—Si—O composition. The different composition ratios of Ta, Si, and O were obtained by changing the oxygen partial pressure and the surface area ratio of Ta to Si in the target. It is proved from the measurements that compositional ratio of $64\% \leqq Ta \leqq 85\%$, $5\% \leqq Si \leqq 26\%$, and $6\% \leqq O \leqq 15\%$ in atomic percents is most suitable for the thin film resistor 3. Details of the measurements are described in the copending U.S. patent application, entitled "INK JET PRINTING DEVICE", filed by Mitani et al. on Dec. 23, 1996, the disclosure of which is hereby incorporated by reference.

It is noted, however, that other materials can be used as long as the materials can be formed with thin and stable oxidation films by a thermal oxidation technique as described below.

The upper surface of the Ta—Si—O ternary alloy thin-film heater 3 is thermally oxidized into an oxidation layer 4. This oxidation film 4 has an electrically-insulation property and has a good anti-galvanization property against electrolytic ink 8 filled in the ink channel 11. The oxidation film 4 prevents the nonoxidized inner portion of the heater 3 from coming directly into contact with electrolytic ink 8 filled in the ink channel 11. Accordingly, the life of each Ta—Si—O ternary alloy thin-film heater 3 will not be shortened by galvanization. Because the oxidized portion 4 is extremely thin, heat is transferred to the ink 8 equally as well as with the case where the heater 3 is not provided with the oxidized portion 4.

The oxidation film 4 will be described below in greater detail hereinafter.

Ta—Si—O ternary alloy thin-film resistor has a certain thermal oxidation property. According to this thermal oxidation property, the resistance of the Ta—Si—O ternary alloy thin-film resistor gradually increases when the resistor is placed in an air atmosphere under high temperature more than 500° C. More specifically, the Ta—Si—O ternary alloy thin-film resistor is stable even when heated in an oxygen atmosphere at temperature of less than 400° C. However, when the temperature increases to reach the range of 450° C. and 500° C., the Ta—Si—O ternary alloy thin-film resistor begins being oxidized at its surface. When the Ta—Si—O ternary alloy thin-film resistor is heated in an oxidizing gas, such as air and oxygen, under 500° C. for ten minutes, the Ta—Si—O ternary alloy thin-film resistor will be oxidized at its surface to a depth in the range of 100 to 200 Å. In other words, the Ta—Si—O alloy thin-film resistor is formed with an electrically-insulating layer of a thickness in the range of 100 to 200 Å. The Ta—Si—O ternary alloy thin-film resistor thus covered with the insulation layer will be stable unless the film is further heated under temperature of more than 500° C. When the Ta—Si—O ternary alloy thin-film resistor covered with the insulation layer is employed in the print head, the resistor will be heated to a temperature in the range of 300 to 350° C. or less when applied with pulses to eject ink droplets. Accordingly, the film will stably perform the jet printing operation.

Additional measurements were performed in which two Ta—Si—O thin film samples with compositional ratios of Ta:Si:O=74%:17%:9% and Ta:Si:O=67%:11%:22% in atomic percents were heated at a speed of 10° C./min. in an atmosphere up to a maximum temperature of 500° C. The maximum temperature of 500° C. was maintained for ten minutes, whereupon the samples were cooled at a speed of 10° C./min. This thermal oxidation process oxidized the surfaces of the samples to a depth of about 100 Å and changed the surfaces to defect-free insulative layers. It was confirmed by a variety of methods that the volume of this portion increases approximately 200 Å and becomes more dense and uniform. When thermally oxidized in this manner, The Ta—Si—O thin films with the already-described compositional range $64\% \leqq Ta \leqq 85\%$, $5\% \leqq Si \leqq 26\%$, and $6\% \leqq O \leqq 15\%$ were extremely stable with respect to further heating to 500° C. or less. Details of the measurements are also described in the copending U.S. patent application, entitled "INK JET PRINTING DEVICE", filed by Mitani et al. on Dec. 23, 1996, the disclosure of which is hereby incorporated by reference.

Next, the organic insulation layer 7 and the inorganic insulation layer 6 will be described below.

The organic insulation layer 7 entirely covers the individual conductor 5 and further covers part of the heater 3 connected to the conductor 5 via the inorganic insulation layer 6. The ink acts like an electrolyte with the same potential as the common conductor 14. The individual conductor 5 has a higher (or lower) potential than the ink. However, because the conductor 5 is separated from the ink by the insulation layers 6 and 7, there is no possibility of the conductor 5 being effected by galvanization with the ink. On the other hand, the common conductor 14 does not need to be covered with the insulation layer 6 or 7 because the conductor 14 and the ink are at the same potential so that the conductor 14 will not corrode. The organic insulation layer 7 is made from a heat-resistant resin such as polyimide which has a thermal breakdown starting point of 400° C. or more.

As apparent from FIG. 2, the thermal insulation layer 6 is provided between the organic insulation layer 7 and the thin-film resistor 67 and the individual conductor 5. The thermal insulation layer 6 is made of inorganic material such as $SiO_2$ and $Ta_2O_5$. The inorganic insulation layer 6 can decrease the maximum temperature, to which the organic insulation layer 7 is exposed, thereby providing a highly reliable ink jet recording head.

Even though the inorganic insulation layer 6 has a small thickness of only 0.5 μm, the inorganic insulation layer 6 can effectively insulate heat. Accordingly, the temperature of the inorganic insulation layer 6 will not exceed 250° C. at the surface covered with the organic insulation layer 7. Therefore, the organic insulation layer 7, formed from resin, such as polyimide, which has a thermal breakdown start temperature of 250° C. or more, will be reliably protected from heat by the inorganic insulation layer 6.

With the above-described arrangement, the inorganic insulation layer 6 serves to electrically insulate the individual conductor 5 from ink 8 and to thermally insulate the organic insulation wall 7 from heat generated at the thin-film resistor 3. Because the layer 6 is provided in direct contact with the thin-film resistor 3 whose temperature possibly reaches 400° C. or more, the layer 6 necessarily has both good heat resistance property and good heat insulation property. Accordingly, the layer 6 is made of inorganic material, such as $SiO_2$ and $Ta_2O_5$, with both the high heat resistance property and the high heat insulation property.

The organic insulation wall 7 serves not only to electrically insulate the inorganic insulation layer 6 and the individual conductor 5 from ink 8 but also to cover voids or damages formed in the inorganic insulation layer 6. It is noted that the inorganic material insulation layer 6 is produced through a sputtering process as will be described later, and therefore the layer 6 is constructed from a plurality of clusters of atoms, between which a plurality of voids are produced. Accordingly, in order to protect the voids from ink 8, the insulation wall 7 is preferably made of organic material with a high density that can prevent ink from passing therethrough. Such a highly dense organic material can protect the voids in the inorganic material layer 6 from ink.

The inorganic insulation layer 6 is liable to have voids especially at a stepped portion 9 that covers an edge of the individual conductor 5, i.e., an edge 100A of a connection region 100 where the conductor 5 is connected to the thin-film resistor 3. This is because it is difficult to provide the inorganic material 6 on the vertically-rising edge of the conductor 5 through the sputtering process. However, the organic insulation layer 7 completely covers the voids, thereby preventing the galvanization corrosion of the inorganic insulation layer 6.

In this way, the organic insulation layer 7 and the inorganic insulation layer 6 solve the problems of each other, and bring their excellent characteristics most effective.

As described above, the common thin-film conductor 14, which is at a position opposite to the individual thin-film conductor 5, has the same electric potential as ink. Therefore, there is no need to insulate the common conductor 14 from ink. However, when the common conductor 14 is formed from a highly electro-conductive metal such as aluminum or copper, the common conductor should be protected from corrosion damage by ink with the same manner as the individual conductor 5 as shown in FIG. 2.

Next, a process of producing the ink jet recording head of the present embodiment will be described.

A $SiO_2$ insulation layer 2 is first formed to 1 to 2 μm thickness on a silicon substrate 1 using a thermal oxidation process, a sputtering process, or a chemical vapor deposition (CVD) process. However, if the driving circuit 18 is needed to be integrally formed on the silicon substrate, a silicon wafer previously formed with the driving circuit 18 can be used instead. Because the silicon wafer is already formed with the driving circuit 18 and also with the $SiO_2$ insulation layer 2, the above-described insulation layer-forming process is not necessary in this case. Details are described in copending U.S. patent application Ser. No. 08/761,900, the disclosure of which is hereby incorporated by reference.

Next, the Ta—Si—O ternary alloy thin film 3 is formed on the $SiO_2$ insulation layer 2 through the reactive sputtering process in a manner as described already. The Ta—Si—O ternary alloy thin film 3 is formed to a thickness of about 0.1 micron. Then, the nickel thin films 5 and 14 are formed on the Ta—Si—O ternary alloy thin film 3 also through a sputtering process such as a high-speed sputtering process. The sputtering process can be performed in the same DC sputtering device in which the Ta—Si—O ternary alloy thin film 3 is produced. The nickel thin films 5 and 14 are formed to about a 1 micron thick. Then, these thin films are photoetched to form the thin-film thermal resistor 3, the individual electrode 5 and the common electrode 14.

Then, the resultant product is placed in an oxidizing atmosphere at 350° C. or more. That is, the resultant product is placed in an oven filled with air or oxygen gas, and is subjected to thermal oxidation process in a manner as described already. The thermal oxidation process oxidizes the surface of the thin-film thermal resistor 3, thereby forming the oxidation film 4. Incidentally, once the resistor 3 underwent oxidation process at 350° C. or more, resistance thereof remains unchanged even when the resistor 3 is pulsingly heated in the range of 320° C. to 330° C.

When the silicon wafer, integrally provided with driving circuits, is used as the substrate 1, the temperature of the atmosphere may not be set more than 400° C. during the oxidation process in order to avoid damaging an aluminum wiring provided to the driving circuit. In this case, instead of placing the resultant product in the heated atmosphere, pulses of heat may be applied to the thin-film resistor 3 in a not-heated oxidizing atmosphere. The pulses heat up the thin-film resistor 3 to the range of 500 and 600° C., thereby forming the oxidation film 4 thereon.

As a result, the surface of the Ta—Si—O ternary alloy thin film resistor 3 having a 0.1 μm thickness is entirely covered with its oxidation film 4 having a 0.01 μm thickness. Therefore, even if the ink chamber 11 will be filled with electrically conductive ink 8, the thin-film resistor 3 will be kept electrically insulated.

Next, an inorganic insulation layer 6 is formed through a liftoff process. It is noted that a photo-etching technique, which is usually employed in the thin film producing process, cannot be employed in this case. This is because when an inorganic insulation layer 6 is removed by photo-etching technique, the $SiO_2$ insulation layer 2, which is formed from the material similar to the inorganic insulation layer 6, will be removed together. Though the liftoff technique is difficult to apply to a forming process of a thick film, because the insulation layer 6 has a thickness as small as 0.5 μm, the liftoff technique is applicable.

Figure 4:
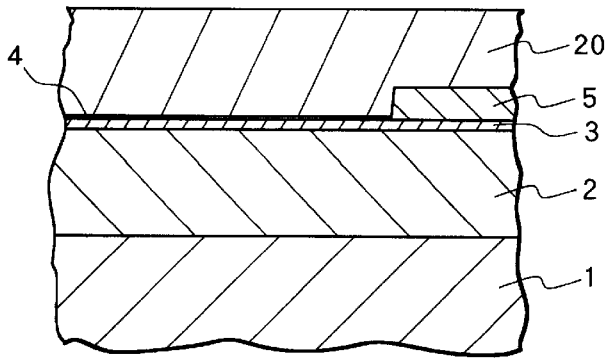
FIGS. 4(*a*) through 4(*d*) illustrate how to form an inorganic insulation layer 6.
Figure 4:
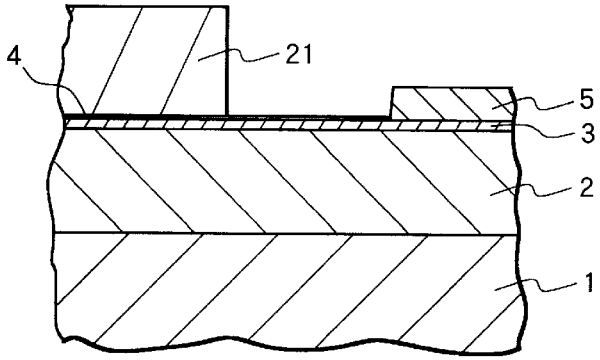
Figure 4:
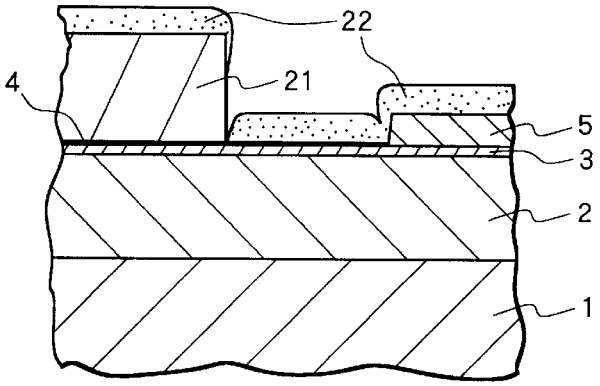
Figure 4:
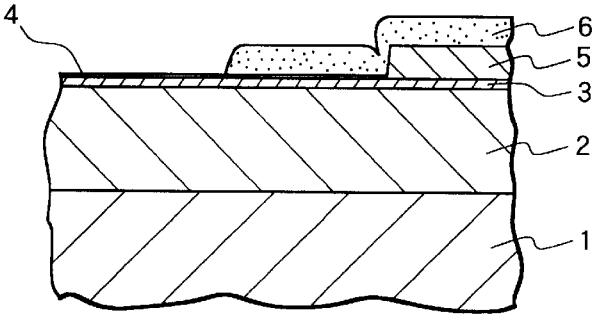

During the liftoff process, the surface of the resultant product is first coated with photoresist 20 as shown in FIG. 4(*a*). Then, the photoresist 20 is exposed to light and is developed to form a resist film 21 over the surface except a portion to be covered with the inorganic insulation layer 6 as shown in FIG. 4(*b*). At this time, the thickness of the resist film 21 must be two to three times thicker than that of the inorganic insulation layer 6 to be formed. Therefore, if the inorganic insulation layer 6 has a large thickness, this liftoff technique is difficult to be applied.

Then, the resultant product is further coated by an inorganic material 22 to a 0.3 to 0.5 μm thickness through a sputtering process as shown in FIG. 4(*c*). The inorganic material is selected as material having a small thermal conductivity. Representative examples of the inorganic material are $SiO_2$ and $Ta_2O_5$.

Next, the resist layer 21 is removed using removing agent as shown in FIG. 4(*d*). As a result, the thin-film conductor 5 and a part of the thin-film resistor 3 are coated by the inorganic insulation layer 6 as shown in FIG. 2.

It is desirable that the inorganic insulation layer 6 cover as small area of the thin-film resistor 3 as possible for better thermal efficiency. Still, the inorganic insulation layer 6 needs to cover some surface area of the thin-film resistor 3 for protecting the organic insulation layer 7 from heat generated by the thin-film resistor 3. Also, the organic insulation layer 7 needs to cover the stepped portion 9, as shown in FIG. 2, so that the portion 9 will not be exposed to ink. These factors concerned, because variation achieved at this thin-film-forming process can be easily held ±1 μm or less, the area of the thin-film resistor 3 to be covered with the inorganic insulation layer 6 is determined to have a length of 5–6 μm. This area of the thin-film resistor 3 covered with the inorganic insulation layer 6 forms a low temperature-exhibiting region A as shown in FIG. 2. In order to produce the ink jet recording head where nozzles 12 are arranged at 360 dpi, that is approximately 69 μm pitch, a nucleation boiling providing region B (high temperature exhibiting portion) is designed to have a square-shaped area with equal sides of approximately 50 μm. Because an area of the entire heating portion C has a width of 50 μm and a length of 55–56 μm, it is apparent that this configuration drops the thermal efficiency only by 10%.

After the inorganic insulation layer 6 is thus formed to the surfaces of the heaters 3 and the conductors 5 through the liftoff process, photosensitive polyimide is provided over the inorganic insulation layer 6 and the $SiO_2$ layer 2 of the silicon substrate 1. Then, the partition wall 7 is formed through etching the polyimide to define the individual ink channels 11 and the common ink channel 13. The organic insulation wall 7 is formed to a thickness of 10 μm. Then, the orifice or nozzle plate 10 is provided over the surface of the partition wall 7. The orifice plate 10 is made from two-layered film of polyimide and epoxy with a total thickness of 33 μm. Nozzles 12 with diameters of 50 μm are formed through the orifice plate 10 using a dry etching technique. The nozzles 12 are formed in the orifice plate 10 at positions in correspondence with the thin-film heaters 3. Details of the process for forming the layers 7 and 10 are described in copending U.S. patent application Ser. Nos. 08/502,179, 08/738,591, 08/761,900, and 08/715,609, the disclosure of which is hereby incorporated by reference.

Ink ejection tests were performed using the thus produced ink jet recording head. Even after the ink jet recording head had ejected two to three hundred million times using seven through eight kinds of ink, including several inks which are stored in commercially-available ink jet printer cartridges, nothing wrong was found with the ink jet recording head.

Also, a comparative ink ejection test was performed onto: a comparative ink jet recording head which was produced to have the same structure as the above-described print head except that the organic insulation layer 7 was made from a dry film resist; and another comparative ink jet recording head which was produced to have the same structure as the above-described print head except that the organic insulation layer 7 was made from a photoresist material. Both the dry film resist and the photoresist have low thermal resistance relative to polyimide. After ejecting 100 million ink droplets, half or more of nozzles of each comparative recording head became impossible to eject. It was found that the nickel individual conductors 5 were corroded, and so were the thin-film resistors 3 at portions close to the nickel individual electrodes 5. Reviewing the test results, the present inventors estimated that the photoresist and the dry film resist, which can resist about only 100° C., had been removed off.

The present inventors performed still another comparative test where each comparative print head was modified so that the thickness of the inorganic insulation layer 6 was increased up to about 1.5 μm. The comparative test shows that each comparative print head with the thus thick insulation layer 6 had no inferiority. It is proved that when sufficiently protected by the thick insulation layer 6, the partition wall 7 formed from even the photoresist or the dry film resist causes no inferiority. Thus, it proved that the partition wall 7 formed from each of the photoresist and the dry film resist can be put to a practical use under an appropriate condition.

Thus, according to the material of the insulation layer 7, the thickness of the inorganic insulation layer 6 is preferably selected in a range of 1 and 2 μm. Through selecting a large value for the thickness of the layer 6, the organic insulation layer 7 can be formed even from dry film resist and photoresist which have a low thermal resistance. Production yields and costs should be considered in order to select whether to use polyimide in combination with the thin layer 6 or to use dry film resist or photoresist in combination with the thick layer 6. That is, this selection should be performed based on production costs of the organic material and of the inorganic material and costs of the organic material.

In the ink jet recording heads produced as described above, the inorganic insulation layer 6 is not provided over the nickel common conductor 14 which does not corrode with ink. However, when the common conductor 14 is formed from aluminum or copper, which has an excellent conductivity, the common conductor 14 will be easily corroded and destroyed by ink. In this case, the common conductor is also needed to be insulated by the layers 6 and 7 in the same manner as the individual conductor 5 as shown in FIG. 2. This completely prevents the conductors 14 from being destroyed by corrosion damages. Because this configuration drops further only 10% of the thermal efficiency, it requires still low power of 3.3 W×1 μm for the square-shaped thermal resistor 3 with 50 μm sides.

The ink jet recording head of the present embodiment operates as described below.

Each individual ink channel 11 is filled with ink 8 supplied from the ink supply groove 16 via the common ink channel 13. When the LSI drive device 18 supplies an electric pulse to the corresponding thin-film resistor 3 via the corresponding individual conductor 5, the heating region C of the thin-film resistor 3 heats in a thermal pulse. The nucleation boiling providing region B provides a nucleation boiling in the ink 8 to thereby vaporize a small amount of ink positioned on the region B into a vapor bubble. The vapor bubble expands, and the force of the expanding vapor bubble in a direction perpendicular to the surface of the heating area B ejects ink through the orifice 12 toward image recording medium (not shown) which is located in confrontation with the orifice 12.

As described above, according to the present embodiment, the thin-film thermal resistor 3 is covered with the electrically-insulating oxidation film 4. The inorganic insulation layer 6 is formed over the thin-film conductor 5 and a part of the thin-film thermal resistor 3. The organic insulation layer 7 is formed over a part of the inorganic insulation layer 6 that covers the conductor 5 and the connecting edge 100A of the connection region 100 between the conductor 5 and the resistor 3. According to this structure, it is possible to prevent the organic insulation layer 7 from being broken down, that is, from being decomposed. Accordingly, stable ink jet recording can be reliably attained.

It is sufficient that the organic insulation layer 7 be formed over at least the stepped portion 9 of the inorganic insulation layer 6 that covers the connecting edge 100A. With this structure, it is possible to protect the void generated in the stepped portion 9 from ink 8.

A second embodiment will be described below with reference to FIGS. 5, 6(*a*), and 6(*b*). The same reference numerals used in this embodiment refer to the same or similar components or parts as those in the first embodiment.

The second embodiment is directed to a side shooter type ink jet recording heat.

Figure 6:
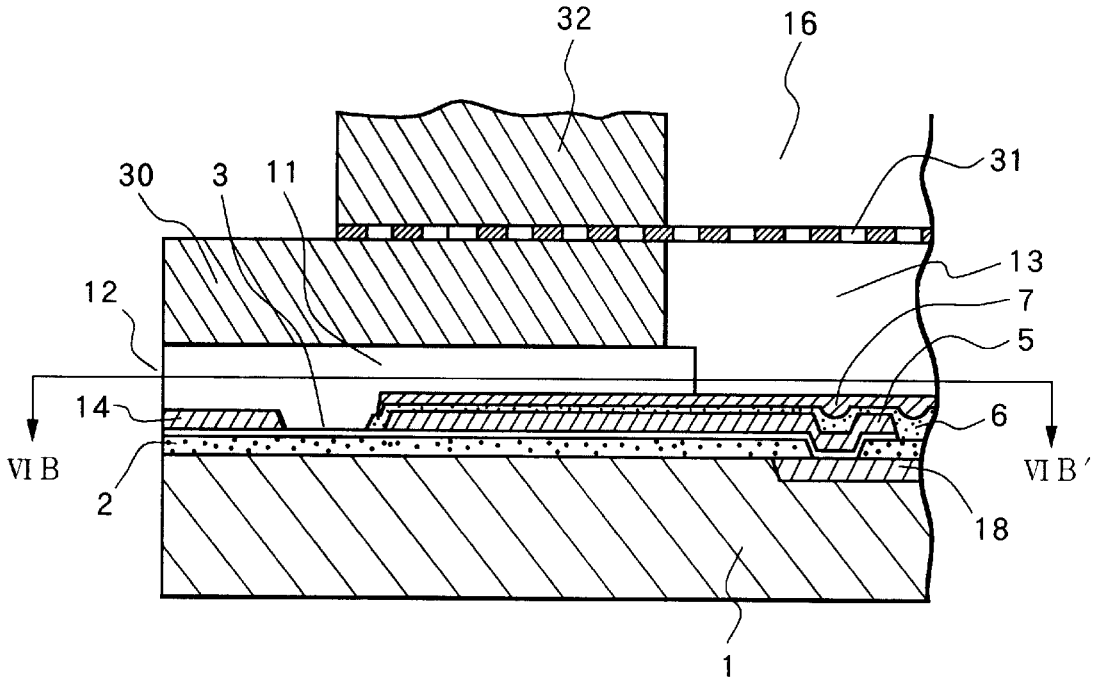
FIG. 6(*a*) is a cross-sectional view showing an ink jet recording head of the second embodiment taken along a line VIA-VIA' of FIG. 6(*b*)
Figure 6:
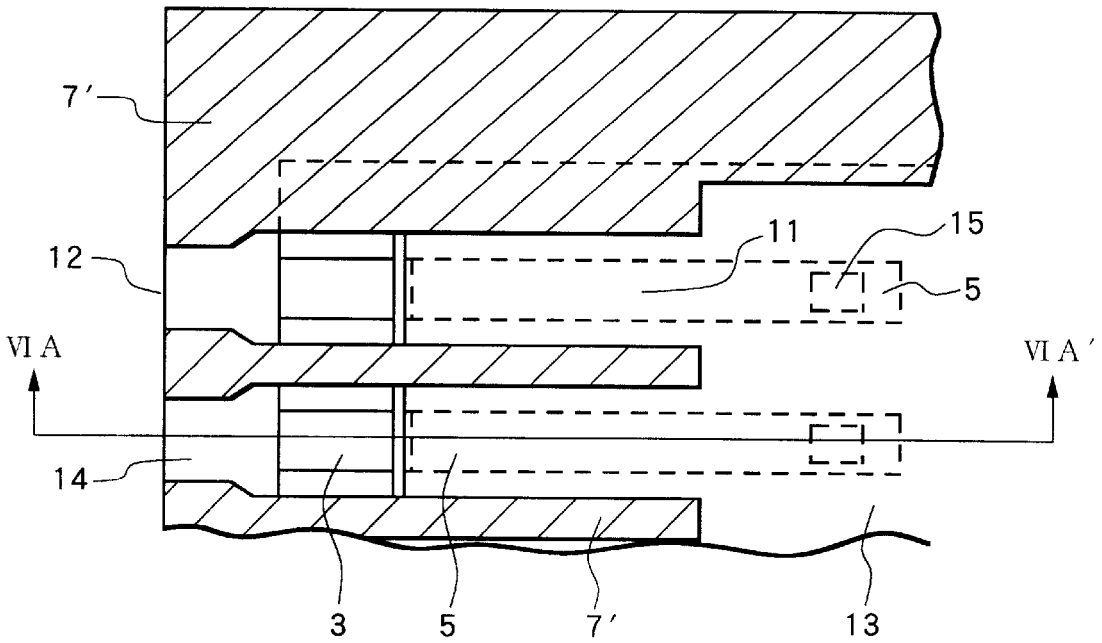

The recording head of this type also has a plurality of individual ink channels 11 arranged as shown in FIG. 6(*b*). According to the side shooter type, each orifice 12 is formed to be axially aligned with the corresponding individual ink channel 11. A partition wall 7' made of the insulation organic material is provided on the substrate 1 ($SiO_2$ layer 2) to separate the individual ink channels 11. Each individual ink channel 11 is communicated, at its one end, to the common ink channel 13 and has, at the other end, an orifice 12 for ejecting a drop ink. The orifice 12 extends from the one end of the ink channel 11 in a direction parallel to the ink channel 11 so that the orifice 12 is axially aligned with the ink channel 11. The heater resistor 3 is provided to the silicon substrate 1 ($SiO_2$ layer 2) defining a bottom wall of the ink channel 11 at such a position that its heating area C is located adjacent to the orifice 12. With such a structure, the orifice 12 extends in a direction parallel to the surface of the heating area C of the thermal resistor 3. According to the side shooter type, a top plate 30 is provided over the partition wall 7'. An ink supply path-providing wall 32 is provided over the top plate 30 with an ink filter 31 being provided between the wall 32 and the top plate 30. The ink supply path-providing wall 32 defines the ink supply groove 16 for supplying ink to the common ink channel 13. The ink supply groove 16 is in fluid communication with an ink cartridge (not shown).

Figure 5:
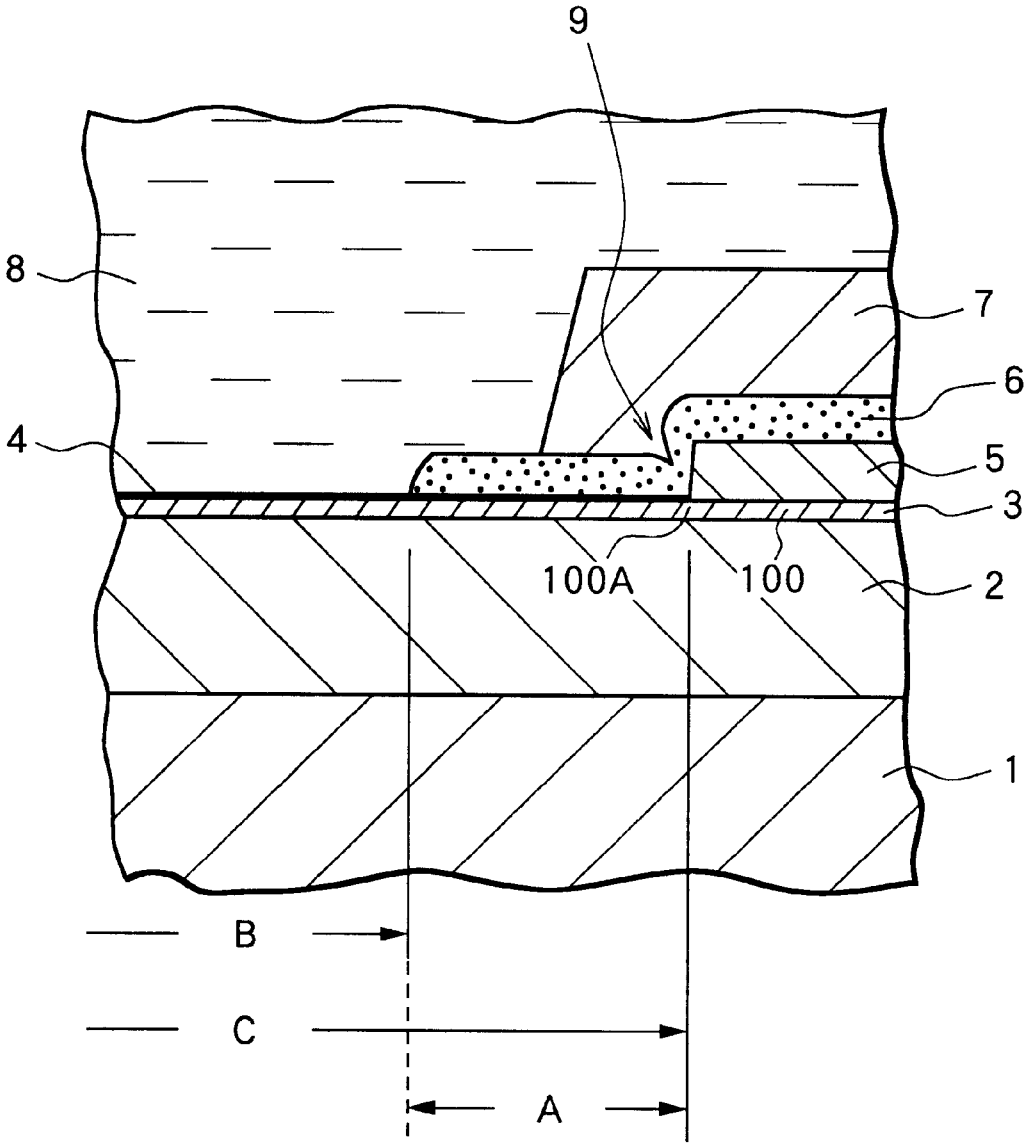
FIG. 5 is an enlarged sectional view of a side shooter type ink jet recording head according to a second embodiment of the present invention.

As shown in FIG. 5, similarly to the first embodiment, the thin-film thermal resistor 3 is covered with the electrically-insulating oxidation film 4. The inorganic insulation layer 6 is formed over the thin-film conductor 5 and a part of the thin-film thermal resistor 3. The organic insulation layer 7 is formed over a part of the inorganic insulation layer 6 that covers the thin-film conductor 5 and the connecting edge 100A of the connection region 100 between the conductor 5 and the resistor 3. According to this structure, it is possible to prevent the organic insulation layer 7 from being broken down, that is, from being decomposed. Accordingly, stable ink jet recording can be reliably attached.

It is sufficient that the organic insulation layer 7 be formed over at least the stepped portion 9 of the inorganic insulation layer 6 that covers the connecting edge 100A. With this structure, it is possible to prevent the void generated in the stepped portion 9 from being damaged by ink 8.

It is noted that according to the present embodiment, the organic insulation layer 7 formed over the inorganic insulation layer 6 is not shaped into the partition wall for separating the individual ink channels 11. The partition wall 7' is formed from organic material the same as that of the insulation layer 7. Except for the above-described points, the structure of the recording head of the present embodiment is the same as that of the first embodiment.

In operation, each ink channel 11 is filled with ink 8 supplied from the ink supply groove 16 and the common ink channel 13 so that the orifice 12 be filled with ink 8. When an electric pulse is applied to the thermal resistor 3 via a corresponding individual conductor 5, the nucleation boiling providing region B of the thermal resistor 3 provides nucleation boiling in the ink 8 to vaporize a small amount of ink 8 placed on the region B into a vapor bubble. The force of the expanding vapor bubble in a direction parallel to the surface of the heating area B of the thermal resistor 3 ejects ink through the orifice 12 toward image recording medium (not shown) which is positioned in front of the orifice 12.

The ink jet recording head of the present embodiment is produced in the same manner as in the first embodiment except that the insulation layer 7 and the partition wall 7' are formed as shown in FIGS. 6(*a*) and 6(*b*) and that the top plate 30, the filter 31, and the wall 32 are provided as shown in FIG. 6(*a*).

As described above, according to the present invention, the thin-film thermal resistor is protected by the oxidation film. Also, the thin-film conductor is protected by the thin inorganic insulation layer and the organic insulation layer. Therefore, ink can be ejected using energy of only ⅕ to 1/10 of energy required with conventional thermal resistors. Accordingly, it is possible to prevent increase of temperature of an ink cartridge to which the ink jet recording head is mounted. It therefore requires no cooling mechanism for cooling the ink cartridge, and therefore the ink jet printer can be manufactured in a low cost and in a compact size. Still, the ink jet recording head of the present invention is highly reliable and is capable of ejecting hundred million ink droplets.

While the invention has been described in detail with reference to specific embodiments therefore, it would be apparent to those skilled in the art that various changes and modifications may be made therein without departing from the spirit of the invention, the scope of which is defined by the attached claims.

What is claimed is:

1. An ink jet recording head, comprising:

a base substrate defining an ink chamber thereon;

a nozzle portion formed with a nozzle connecting the ink chamber with atmosphere;

a thin-film thermal resistor formed on the base substrate in correspondence with the nozzle, the thin-film thermal resistor being pulsingly energized to rapidly vaporize a portion of the ink and to eject an ink droplet from the nozzle using the expansion of the vaporized ink, the thin-film thermal resistor further being covered with an electrically-insulating oxidation layer formed by oxidation of the thin-film thermal resistor;

a thin-film conductor connected at a connection portion to the thin-film thermal resistor for pulsingly energizing the thin-film resistor via a drive device;

an inorganic thermal insulation layer provided over a part of the thin-film thermal resistor, the thin-film conductor and the connection portion being between the thin-film thermal resistor and the thin-film conductor, wherein the inorganic thermal insulation layer extends into the ink chamber so as to cover a portion of the electrically-insulating oxidation layer thereby defining a heating surface as being that portion of the oxidative layer which is exposed to the ink in the ink chamber; and an organic thermal insulation layer covering at least a part of the inorganic thermal insulation layer that covers the connection portion, the inorganic thermal insulation layer providing thermal insulation to the organic thermal insulation layer from heat generated from the thin-film thermal resistor.

2. An ink jet recording head as claimed in claim 1, wherein the connection portion has a connecting edge, and wherein the organic thermal insulation layer covers at least a part of the inorganic thermal insulation layer that covers the connecting edge of the connection portion between the thin-film thermal resistor and the thin-film conductor.

3. An ink jet recording head as claimed in claim 1, wherein the organic thermal insulation layer forms an ink channel wall for defining the ink chamber.

4. An ink jet recording head as claimed in claim 3, wherein the ink channel wall is positioned between the nozzle portion and the base substrate, and the nozzle and the thin-film thermal resistor are facing each other.

5. An ink jet recording head as claimed in claim 1, wherein the nozzle portion is provided directly over the base substrate.

6. An ink jet recording head as claimed in claim 5, further comprising an ink channel wall for defining the ink chamber, wherein the nozzle portion is provided at one end of the ink channel wall so that the nozzle is formed at one end of the ink chamber in an axial alignment therewith.

7. An ink jet recording head as claimed in claim 1, wherein the inorganic thermal insulation layer is produced through a liftoff process and a sputtering process.

8. An ink jet recording head as claimed in claim 1, wherein the thin-film thermal resistor is formed from a Ta—Si—O ternary alloy having a composition of $64\% \leqq Ta \leqq 85\%$, $5\% \leqq Si \leqq 26\%$, and $6\% \leqq O \leqq 15\%$ in atomic percents.

9. An ink jet recording head as claimed in claim 1, wherein the thin-film conductor is made of nickel metal.

10. An ink jet recording head as claimed in claim 1, wherein the nozzle portion is formed with a plurality of nozzles, a plurality of thin-film thermal resistors being formed in correspondence with the plurality of nozzles, a plurality of thin-film conductors being respectively connected to the plurality of thin-film thermal resistors for supplying energization pulses to the thin-film resistors, each thin-film conductor pulsingly energizing the corresponding thin-film thermal resistor to rapidly vaporize a portion of the ink and to eject an ink droplet from the corresponding nozzle, and further comprising a common thin-film conductor connected to all the plurality of thin-film thermal resistors, the common conductor being applied with the same electric potential as an electric potential of the ink.

11. An ink jet recording head as claimed in claim 10, wherein the inorganic thermal insulation layer is provided over a part of each thin-film thermal resistor and each thin-film conductor, and the organic thermal insulation layer covering at least a part of the inorganic thermal insulation layer that covers the connection portion between each thin-film thermal resistor and the corresponding thin-film conductor.

12. An ink jet recording head as claimed in claim 11, wherein the organic thermal insulation layer covers at least a part of the inorganic thermal insulation layer that covers a connecting edge of the connection portion between each thin-film thermal resistor and the corresponding thin-film conductor.

13. An ink jet recording as claimed in claim 1, wherein the thin-film thermal resistor includes a heating surface which is partly exposed in the ink chamber.

14. An ink jet recording head, comprising:

a base substrate defining an ink chamber thereon;

a nozzle portion formed with a nozzle connecting the ink chamber with atmosphere;

a thin-film thermal resistor formed on the base substrate in correspondence with the nozzle, the thin-film thermal resistor being pulsingly energized to rapidly vaporize a portion of the ink and to eject an ink droplet from the nozzle using the expansion of the vaporized ink, the thin-film thermal resistor being covered with an electrically-insulating oxidation layer formed by oxidation of the thin-film thermal resistor;

a thin-film conductor connected at a connection portion to the thin-film thermal resistor for pulsingly energizing the thin-film resistor via a drive device, the connection portion having a connecting edge;

an inorganic thermal insulation layer provided over a part of the thin-film thermal resistor, the thin-film conductor, and the connecting edge of the connection portion between the thin-film thermal resistor and the thin-film conductor, wherein the inorganic thermal insulation layer extends into the ink chamber so as to cover a portion of the electrically-insulating oxidation layer thereby defining a heating surface as being that portion of the oxidative layer which is exposed to the ink in the ink chamber; and an organic thermal insulation layer covering at least a part of the inorganic thermal insulation layer that covers the connection edge of the connection portion.

15. An ink jet recording as claimed in claim 14, wherein the thin-film thermal resistor includes a heating surface which is partly exposed in the ink chamber.

16. An ink jet recording head, comprising:

a base substrate defining an ink chamber thereon;

an ink supply portion for supplying ink to the ink chamber;

a nozzle portion formed with a nozzle connecting the ink chamber with atmosphere;

a thin-film thermal resistor formed on the base substrate in correspondence with the nozzle, the thin-film thermal resistor being pulsingly energized to rapidly vaporize a portion of the ink and to eject an ink droplet from the nozzle using the expansion of the vaporized ink, the thin-film thermal resistor being covered with an electrically-insulating oxidation layer formed by oxidation of the thin-film thermal resistor;

a thin-film conductor connected at a connection portion to the thin-film thermal resistor for pulsingly energizing the thin-film resistor via a drive device;

an inorganic thermal insulation layer provided over a part of the thin-film thermal resistor, the thin-film conductor, and the connection portion between the thin-film thermal resistor and the thin-film conductor, wherein the inorganic thermal insulation layer extends into the ink chamber so as to cover a portion of the electrically-insulating oxidation layer thereby defining a heating surface as being that portion of the oxidative layer which is exposed to the ink in the ink chamber; and an organic thermal insulation layer covering at least a part of the inorganic thermal insulation layer that covers the connection portion.

17. An ink jet recording head as claimed in claim 16, wherein the connection portion has a connecting edge, and wherein the organic thermal insulation layer covers at least a part of the inorganic thermal insulation layer that covers the connecting edge of the connection portion between the thin-film thermal resistor and the thin-film conductor.

18. An ink jet recording head as claimed in claim 16, further comprising driving portion for supplying the energization pulse to the thin-film thermal resistor via the thin-film conductor.

19. An ink jet recording head as claimed in claim 16, wherein the ink supply portion includes an ink cartridge.

20. An ink jet recording as claimed in claim 16, wherein the thin-film thermal resistor includes a heating surface which is partly exposed in the ink chamber.

21. An ink jet recording head, comprising:

a base substrate defining an ink chamber thereon;

a nozzle portion formed with a nozzle connecting the ink chamber with atmosphere;

a thin-film thermal resistor formed on the base substrate in correspondence with the nozzle, the thin-film thermal resistor being covered with an electrically-insulating oxidation layer formed by oxidation of the thin-film thermal resistor;

a thin-film conductor connected at a connection portion to the thin-film thermal resistor for pulsingly energizing the thin-film resistor via a drive device to rapidly vaporize a portion of the ink and to eject an ink droplet from the nozzle using the expansion of the vaporized ink;

an inorganic thermal insulation layer provided over a part of the thin-film thermal resistor, the thin-film conductor and the connection portion being between the thin-film thermal resistor and the thin-film conductor; and an organic thermal insulation layer covering at least a part of the inorganic thermal insulation layer that covers the connection portion, wherein the inorganic thermal insulation layer extends into the ink chamber so as to cover a portion of the electrically-insulating oxidation layer, thereby defining a heating surface as being that portion of the oxidative layer which is exposed to the ink in the ink chamber, and the inorganic thermal insulation layer providing thermal insulation to the organic thermal insulation layer from heat generated from the thin-film thermal resistor.

22. An ink jet recording head, comprising:

a base substrate defining an ink chamber thereon;

a nozzle portion formed with a nozzle connecting the ink chamber with atmosphere;

a thin-film thermal resistor formed on the base substrate in correspondence with the nozzle, the thin-film thermal resistor being covered with an electrically-insulating oxidation layer formed by oxidation of the thin-film thermal resistor;

a thin-film conductor connected at a connection portion to the thin-film thermal resistor for pulsingly energizing the thin-film resistor via a drive device to rapidly vaporize a portion of the ink and to eject an ink droplet from the nozzle using the expansion of the vaporized ink, the connection portion having a connecting edge;

an inorganic thermal insulation layer provided over a part of the thin-film thermal resistor, the thin-film conductor, and the connecting edge of the connection portion between the thin-film thermal resistor and the thin-film conductor; and an organic thermal insulation layer covering at least a part of the inorganic thermal insulation layer that covers the connection edge of the connection portion, wherein the inorganic thermal insulation layer extends into the ink chamber so as to cover a portion of the electrically-insulating oxidation layer, thereby defining a heating surface as being that portion of the oxidative layer which is exposed to the ink in the ink chamber.

23. An ink jet recording head, comprising:

a base substrate defining an ink chamber thereon;

an ink supply portion for supplying ink to the ink chamber;

a nozzle portion formed with a nozzle connecting the ink chamber with atmosphere;

a thin-film thermal resistor formed on the base substrate in correspondence with the nozzle, the thin-film thermal resistor being covered with an electrically-insulating oxidation layer formed by oxidation of the thin-film thermal resistor;

a thin-film conductor connected at a connection portion to the thin-film thermal resistor for pulsingly energizing the thin-film resistor via a drive device to rapidly vaporize a portion of the ink and to eject an ink droplet from the nozzle using the expansion of the vaporized ink;

an inorganic thermal insulation layer provided over a part of the thin-film thermal resistor, the thin-film conductor, and the connection portion between the thin-film thermal resistor and the thin-film conductor; and an organic thermal insulation layer covering at least a part of the inorganic thermal insulation layer that covers the connection portion, wherein the inorganic thermal insulation layer extends into the ink chamber so as to cover a portion of the electrically-insulating oxidation layer, thereby defining a heating surface as being that portion of the oxidative layer which is exposed to the ink in the ink chamber.

* * * * *

UNITED STATES PATENT AND TRADEMARK OFFICE

CERTIFICATE OF CORRECTION

PATENT NO. : 6,161,924
DATED : December 19, 2000
INVENTOR(S) : Mitani et al.

It is certified that error appears in the above-identified patent and that said Letters Patent is hereby corrected as shown below:

Column 15,
Line 1, after "recording", insert -- head --.
Line 34, after "recording", insert -- head --.
Line 37, correct "head" to -- device --.
Line 57, delete "," (comma) after "conductor".
Line 65, correct "at least a part" to -- a portion --.

Column 16,
Line 1, correct "head" to -- device --.
Line 7, correct "head" to -- device --.
Line 11, correct "head" to -- device --.
Line 13, after "recording", insert -- device --.
Line 61, after "provided", insert -- directly --.

Column 17,
Line 9, correct "head" to -- device --.

Column 18,
Line 6, after "provided", insert -- directly --.
Line 11, correct "at least a part" to -- a portion --.

Signed and Sealed this

Sixth Day of August, 2002

*Attest:*

*Attesting Officer*

JAMES E. ROGAN
*Director of the United States Patent and Trademark Office*